US007413772B2

(12) United States Patent
Rhee et al.

(10) Patent No.: US 7,413,772 B2
(45) Date of Patent: Aug. 19, 2008

(54) METHOD FOR COATING THERMOPLASTIC RESIN BEADS FOR USE IN IMITATION PEARLS

(76) Inventors: Young Nam Rhee, 201, Noblehouse, 100-1, BanPo-Dong, SeoCho-Gu, Seoul (KR); Sang Min Rhee, #10, 430 Galleria Dr., San Jose, CA (US) 95134

( * ) Notice: Subject to any disclaimer, the term of this patent is extended or adjusted under 35 U.S.C. 154(b) by 836 days.

(21) Appl. No.: 10/825,197

(22) Filed: Apr. 16, 2004

(65) Prior Publication Data

US 2005/0233075 A1 Oct. 20, 2005

(51) Int. Cl.
*B05D 7/00* (2006.01)

(52) U.S. Cl. ..... 427/222; 427/407.1

(58) Field of Classification Search ..... 427/214, 427/218, 222, 407.1

See application file for complete search history.

(56) References Cited

U.S. PATENT DOCUMENTS 1,607,622 A * 11/1926 Higgins ..... 156/61
1,868,851 A 7/1932 Rocker et al.
1,969,477 A 8/1934 Rittman
1,982,280 A * 11/1934 Bell ..... 106/163.01
2,384,493 A 9/1945 Rolle
3,342,686 A 9/1967 Jewel et al.

* cited by examiner

*Primary Examiner*—Michael Cleveland
*Assistant Examiner*—Robert Vetere
(74) *Attorney, Agent, or Firm*—John K. Park; Park Law Firm

(57) ABSTRACT

A method for coating thermoplastic resin beads for use in imitation pearls includes the steps of: applying to celluloid a surface treatment compound (A) dissolved into a mixed solution of acetone, ethylacetate, butylacetate, and benzene; coating the surface treated celluloid with compounds for an under coat and a mid coat, each compound being obtained by dissolving celluloid into a mixed solution of ethylacetate and amylacetate, and adding a pigment thereto; and coating the celluloid with a compound for a top coat (D) that is prepared by dissolving celluloid into ethylacetate, and adding a pigment thereto.

1 Claim, No Drawings

METHOD FOR COATING THERMOPLASTIC RESIN BEADS FOR USE IN IMITATION PEARLS

BACKGROUND OF THE INVENTION

1. Field of the Invention

The present invention relates in general to a method for coating thermoplastic resin beads for use in imitation pearls. More specifically, surface of celluloid is treated with a surface treatment compound (A) having been dissolved into a mixed solution of acetone, ethylacetate, butylacetate and benzene, and the surface treated celluloid is coated with: a compound for an under coat (B), a compound for a mid coat (C), and a compound for a top coat (D), wherein each of the compounds (B), (C), and (D) is prepared by adding a pigment to a mixed solution of ethylacetate and amylacetate.

2. Description of the Related Art

In general, thermoplastic resins are very sensitive to chemicals, and thus it was difficult to coat beads with those resins. Even though the coating process was succeeded, it did not increase merchantability of the beads.

However, industrial development has succeeded to mass-produce nontoxic and environmentally friendly imitation pearls made of thermoplastic resin. Moreover, the coating method of the mass-produced pearls was very easy and gave excellent color and luster to the pearls. Thusly produced pearls were high quality and hardly defective.

Industrial development also brought positive changes on ornaments and raised more interests in accessories. As people live in more comfortable circumstances than the past, their interests in ornaments and accessories have grown naturally.

Among them is the imitation pearl. As described above, imitation pearls could be mass produced and are no way inferior to natural pearls in terms of the texture, so they are widely used for accessories, necklaces, rings, brooches, toys and so on.

To make imitation pearls for ornamental purposes, cellulose nitrate (or simply, cellulose) is dissolved in diverse solvents, and pigments are added thereto. Then, resin beads are coated with the mixture of the cellulose solution and the pigments.

In the past, basic lead carbonate ($2PbCO_3Pb(OH)_2$), which is a compound of a lead (Pb)-containing neutral salt and a hydroxide, was usually used for the pigment to be added to the cellulose solution. Although the basic lead carbonate was effective for creating almost same texture and luster with natural pearls, it had deadly effects on a human body and was a major environmental contaminant.

To resolve the above-described problems, a new technique has been recently proposed. According to the new technique, cellulose was dissolved in a solvent of acetone or butylacetate, and a harmless pigment, bismuthoxychloride (BiOCl), was added to the cellulose solution.

However, as long as nitrocellulose itself was used, solubility and dispersibility of pigments based on titanium dioxide and bismuthoxychloride were poor. Also, imitation pearls made of nitrocellulose were easily turned to yellow because of nitrocellulose being very sensitive to ultraviolet rays. Although there was another technique introduced to get the same texture and physical properties with natural pearls by mixing titanium dioxide with a specific pigment (highlight pearl green), its manufacturing process was very complicated, and matching appropriate components and contents therefor was often failed. As a result, it seemed to be almost impossible to manufacture imitation pearls having gentle and bright colors like natural pearls, and this inferiority only deteriorated merchantability of the imitation pearls.

In the past, high impact non-coated thermoplastic resins like acryl, ABS, and PS were used as the materials of the bead. However, when the surface of the bead was polished, the bead still showed weakness to chemicals during the coating process. Needless to say, the bead was low in quality.

SUMMARY OF THE INVENTION

It is, therefore, an object of the present invention to provide a method for coating thermoplastic resin beads, in which the surfaces of the beads after going through a polishing process are strong at chemicals during a coating process.

To achieve the above object, there is provided a method for coating thermoplastic resin beads for use in imitation pearls, the method including the steps of: applying to celluloid a surface treatment compound (A) dissolved into a mixed solution of acetone, ethylacetate, butylacetate, and benzene; coating the surface treated celluloid with compounds for an under coat and a mid coat, each compound being obtained by dissolving celluloid into a mixed solution of ethylacetate and amylacetate, and adding a pigment thereto; and coating the celluloid with a compound for a top coat (D) that is prepared by dissolving celluloid into ethylacetate, and adding a pigment thereto.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

At first, a surface treatment compound (A) is dissolved into a mixed solution of 14-18 wt % of acetone, 36-42 wt % of amylacetate, 18-22 wt % of butylacetate, and 3-6 wt % of benzene. Then, 12-29 wt % of celluloid is treated with the surface treatment compound (A).

Afterwards, 22-33 wt % of the surface treated celluloid is coated with: (1) a compound for an under coat (B), which is obtained by dissolving the 22-33 wt % of the surface treated celluloid into a mixed solution of 33-38 wt % of ethylacetate and 33-38 wt % of amylacetate, and adding 1-5 wt % of a pigment, (2) a compound for a mid coat (C), which is obtained by dissolving the 22-33 wt % of the surface treated celluloid into a mixed solution of 25-29 wt % of ethylacetate and 40-44 wt % of amylacetate, and adding 1-5 wt % of a pigment, or a compound for a top coat (D), which is obtained by dissolving the 22-33 wt % of the surface treated celluloid into a mixed solution of 20-26 wt % of ethylacetate and 46-49 wt % of amylacetate, and adding 0.1-1 wt % of a pigment.

As for the solvent for the surface treatment compound (A), benzene can be replaced by toluene or another compound of the same aromatic compound group.

Also, when the amounts of acetone and ethylacetate in the solvent of celluloid for use in the under coat and the mid coat are too great, the coats dry too fast and the bead loses its luster.

Therefore, the present invention uses a camphor containing celluloid, instead of nitrocellulose, as a plasticizer, and adds to the general solvent for the celluloid (composed of acetone, butylacetate, and ethylacetate) a lubricative amylacetate, which is an ester compound of acetic acid and amyl alcohol. By mixing acetone, butylacetate, ethylacetate, and amylacetate at a specific ratio, an optimal surface treatment compound (A) is obtained.

As for the pigment, a liquid pearl pigment whose main ingredient is bismuthoxychloride is used. If necessary, the liquid pearl pigment can be replaced by carbonate, but it does not have to be titanium dioxide though. Preferably, the pigment particle size is 5-25 μm.

The reason for adding amylacetate to the solvent for celluloid is because the amylacetate is not soluble in the thermoplastic resin, and but a stable solute not causing any problem on the surface of the bead.

The following describes more details on the surface treatment and how to obtain compounds for under-, mid- and top-coats of the bead.

EXAMPLE 1

Surface Treatment

Added to a 20 liter flask is a 4 kg of an original state of celluloid chips. Then, 3 kg of acetone, 7.5 kg of ethylacetate, 1.2 kg of benzene, and 3.5 kg of butylacetate are added to the flask.

Finally, a thermoplastic resin bead is added to the mixed solution in the flask to activate the surface of the bead.

EXAMPLE 2

Under Coat

Added to a 20 liter flask is an 8 kg of an original state of celluloid chips, and 10 kg of ethylacetate.

The mixture of celluloid chips and ethylacetate is continuously agitated, and 10 kg of amylacetate is added to the flask. By adding amylacetate, the resulting mixture becomes a little sticky.

Afterward, 1-1.5 kg of a liquid pearl pigment whose main ingredient is bismuthoxychloride is added to the flask to obtain a viscous liquid compound for an under coat of the bead. Finally, the thermoplastic resin bead of Example 1 is immersed or pickled and coated with the above-described liquid compound, and dried at 45° C. for 23-30 minutes.

EXAMPLE 3

Mid Coat

The same method with Example 2 is used, except that 8 kg of ethylacetate and 12 kg of amylacetate are added to the flask, to yield a compound for a mid coat of the bead.

The thermoplastic resin bead of Example 1 is immersed and coated with the compound for the mid coat, and dried.

EXAMPLE 4

Top Coat

Added to a 20 liter flask is an 8 kg of an original state of celluloid chips, 8 kg of ethylacetate, and 12 kg of amylacetate.

The mixture of celluloid chips and ethylacetate is continuously agitated, and 0.1-1 wt % of a liquid pearl pigment whose main ingredient is bismuthoxychloride is added to the flask to obtain a compound for a top coat of the bead.

Finally, the thermoplastic resin bead of Example 1 is immersed and coated with the above described compound, and is dried.

Thusly obtained imitation pearl contains below 0.0025 ppm lead, and its luster is bright and gentle just like natural pearls.

Although it is preferable to use the compound for the under coat (B), the compound for the mid coat (C), and the compound for the top coat (D) in sequence, one of the compounds can be omitted or one compound can be used repeatedly.

For instance, the surface treated bead can be coated with only two compounds, namely the compound for the mid coat (C) and the compound for the top coat (D). Also, the surface treated bead can be coated only with the compound for the top coat (D) 3-4 times.

There are several ways for coating the bead with the compounds, such as spray, immersion, and painting.

In addition, it is perfectly all right to dissolve the celluloid into the solution of acetone or ethylacetate, and to add to the mixture other ingredients at a designated ratio whenever needed.

The mixture ratio is not fixed but adjustable, so ingredients can be added more or less according to different needs.

Meanwhile, it is not absolutely required to coat the surface treated bead with the compounds for under-, mid- and top-coats. Actually the resin bead can go through the surface treatment process and then be coated with only one of the compounds.

In conclusion, the method for coating thermoplastic resin beads for use in imitation pearls includes the steps of: applying a surface treatment compound (A) to celluloid, the surface treatment compound (A) having been dissolved into a mixed solution of acetone, ethylacetate, butylacetate, and benzene; coating the surface treated celluloid with compounds for an under coat and a mid coat, each compound being obtained by dissolving celluloid into a mixed solution of ethylacetate and amylacetate, and adding a pigment thereto; and coating the celluloid with a compound for a top coat (D) that is prepared by dissolving celluloid into ethylacetate, and adding a pigment thereto.

Therefore, the polished and coated surface of the bead according to the invention is not sensitive to chemicals and thus, can be widely used in diverse related fields.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for coating thermoplastic resin beads for use in imitation pearls, the method comprising the steps of:

dissolving 12-29 wt % of pyroxylin into a mixed solution of 14-18 wt % of acetone, 36-42 wt % of ethylacetate, 18-22 wt % of butylacetate, and 3-6 wt % of benzene to form surface treatment compound (A);

adding the thermoplastic resin bead to surface treatment compound (A) to form a treated thermoplastic resin bead; and coating the treated thermoplastic resin bead with at least one of a compound for an under coat (B), a compound for a mid coat (C) and a compound for a top coat (D), wherein the compound for the under coat (B) is prepared by dissolving 22-33 wt % of the pyroxylin into a solvent of 33-38 wt % of ethylacetate and 33-38 wt % of amylacetate and adding 1-5 wt % of a pigment thereto, the compound for the mid coat (C) is prepared by dissolving 22-33 wt % of the pyroxylin into a solvent of 25-29 wt % of ethylacetate and 40-44 wt % of amylacetate and adding 1-5 wt % of a pigment thereto, and the compound for the top coat (D) is prepared by dissolving 22-33 wt % of the pyroxylin into a solvent of 46-49 wt % of amylacetate and 20-26 wt % of ethylacetate and adding 0.1-1 wt % of a pigment thereto.

* * * * *